US008337665B2

(12) United States Patent
Esser et al.

(10) Patent No.: US 8,337,665 B2
(45) **Date of Patent: *Dec. 25, 2012**

(54) METHOD FOR PRODUCING PAPER, PAPERBOARD AND CARDBOARD

(75) Inventors: Anton Esser, Mannheim (DE); Rainer Blum, Mannheim (DE); Joachim Kuhn, Frankenthal (DE); Marc Leduc, Speyer (DE); Ralf Hemel, Worms (DE)

(73) Assignee: BASF SE, Ludwigshafen (DE)

( * ) Notice: Subject to any disclaimer, the term of this patent is extended or adjusted under 35 U.S.C. 154(b) by 964 days.

This patent is subject to a terminal disclaimer.

(21) Appl. No.: 10/590,933

(22) PCT Filed: Mar. 14, 2005

(86) PCT No.: PCT/EP2005/002685

§ 371 (c)(1),
(2), (4) Date: Aug. 28, 2006

(87) PCT Pub. No.: WO2005/090678

PCT Pub. Date: Sep. 29, 2005

(65) Prior Publication Data

US 2007/0181274 A1 Aug. 9, 2007

(30) Foreign Application Priority Data

Mar. 16, 2004 (DE) ..... 10 2004 013 007

(51) Int. Cl.
*D21H 17/33* (2006.01)
*D21H 17/56* (2006.01)
*D21H 21/02* (2006.01)

(52) U.S. Cl. ..... 162/168.2; 162/158; 162/164.1; 162/164.6; 162/168.1; 162/185

(58) Field of Classification Search ..... 162/158, 162/168.1, 168.2, 185, 164.1, 164
See application file for complete search history.

(56) References Cited

U.S. PATENT DOCUMENTS

| | | | | |
|---|---|---|---|---|
| 4,444,667 | A * | 4/1984 | Burkert et al. | 210/735 |
| 4,753,710 | A * | 6/1988 | Langley et al. | 162/164.3 |
| 5,501,774 | A * | 3/1996 | Burke | 162/164.1 |
| 5,676,796 | A * | 10/1997 | Cutts | 162/158 |
| 5,720,888 | A | 2/1998 | Kuo et al. | |
| 6,083,348 | A * | 7/2000 | Auhorn et al. | 162/183 |
| 6,132,558 | A * | 10/2000 | Dyllick-Brenzinger et al. | 162/164.6 |
| 6,273,998 | B1 * | 8/2001 | Kuo et al. | 162/168.2 |
| 6,379,501 | B1 * | 4/2002 | Zhang et al. | 162/181.7 |
| 6,797,785 | B1 * | 9/2004 | Hund et al. | 525/328.2 |
| 7,918,965 | B2 * | 4/2011 | Leduc et al. | 162/168.1 |
| 8,029,647 | B2 * | 10/2011 | Leduc et al. | 162/164.6 |
| 2002/0100564 | A1 * | 8/2002 | Harvey et al. | 162/5 |
| 2003/0192664 | A1 * | 10/2003 | Kulick et al. | 162/164.1 |
| 2004/0250972 | A1 * | 12/2004 | Carr | 162/164.1 |
| 2005/0247420 | A1 * | 11/2005 | Blum et al. | 162/158 |

FOREIGN PATENT DOCUMENTS

| | | | |
|---|---|---|---|
| EP | 71050 | A1 * | 2/1983 |
| EP | 0 216 387 | | 4/1987 |
| EP | 0 249 891 | | 12/1987 |
| EP | 0 438 707 | | 12/1993 |
| EP | 0 438 755 | | 3/1994 |
| EP | 0 910 701 | | 10/2000 |
| EP | 0 980 450 | | 10/2002 |
| WO | 98/48112 | | 10/1998 |
| WO | WO 2004/061235 | A1 * | 7/2004 |

OTHER PUBLICATIONS

Smook, Gary A., Handbook for Pulp and Paper Technologists, 2nd ed, Angus Wilde Publications, 1992, pp. 208, 212-214.*

* cited by examiner

*Primary Examiner* — Matthew Daniels
*Assistant Examiner* — Dennis Cordray
(74) *Attorney, Agent, or Firm* — Oblon, Spivak, McClelland, Maier & Neustadt, L.L.P.

(57) ABSTRACT

A process for the production of paper, board and cardboard by draining a paper stock containing interfering substances in the presence of polymers which contain vinylamine units and which have an average molar mass $M_w$ of at least 1 million, a high-consistency stock first being prepared, at least one polymer containing vinylamine units and having an average molar mass $M_w$ of at least 1 million and a degree of hydrolysis of from 1 to 20 mol % being metered into the high-consistency stock, the high-consistency stock being diluted to a low-consistency stock by adding water, and the low-consistency stock being drained, and the use of hydrolyzed homo- or copolymers of N-vinylcarboxamides having a degree of hydrolysis of from 1 to 20 mol % and an average molar mass $M_w$ of at least 1 million in the production of paper, board or cardboard as an additive to a high-consistency stock containing interfering substances, for reducing deposits in the wire part, press section and drying section of paper machines.

16 Claims, No Drawings

METHOD FOR PRODUCING PAPER, PAPERBOARD AND CARDBOARD

The present invention relates to a process for the production of paper, board and cardboard by draining a paper stock containing interfering substances in the presence of polymers which contain vinylamine units and which have an average molar mass $M_w$ of at least 1 million.

EP-A-0 438 707 discloses a process for the production of paper, board and cardboard by draining a paper stock containing interfering substances in the presence of hydrolyzed homo- and/or copolymers of N-vinylformamide having a degree of hydrolysis of at least 60% as a fixing agent and cationic retention aids. The polymers used as fixing agents have Fikentscher K values of from 30 to 150 (measured in 5% strength aqueous sodium chloride solution at a polymer concentration of 0.5% by weight and a temperature of 25° C.).

Paper, board and cardboard are produced by the process disclosed in EP-A-0 438 755 by draining a paper stock containing interfering substances in the presence of polymers which contain vinylformamide and vinylamine units and which have Fikentscher K values of at least 130 (determined in 5% strength by weight aqueous sodium chloride solution at 25° C. and a polymer concentration of 0.1% by weight). The average molar mass $M_w$ of the polymers used in the examples is above 1 million. The polymers are obtainable, for example, by hydrolysis of homopolymers of N-vinylformamide. The degree of hydrolysis of the polymers is less than 10 mol %. The hydrolyzed polymers are used as drainage aids, retention aids and flocculants to a low-consistency stock (consistency of, for example, from 0.4 to 0.5% by weight) in amounts of from 0.002 to 0.1% by weight, based in each case on dry paper stock.

WO-A-98/48112 discloses a process for the production of paper, board and cardboard, a paper stock containing interfering substances being drained in the presence of a fixing agent comprising an N-vinylformamide homo- or copolymer having a degree of hydrolysis of from 25 to 55% and a Fikentscher K value of from 30 to 150 (determined in 1% strength by weight aqueous solution at 25° C.) and a retention aid.

Although the polymers containing vinylamine units and disclosed in the abovementioned publications are good fixing agents or drainage aids, flocculants and retention aids, problems with deposition in the wire part, press section and drying section of the paper machine still occur in practice when processing paper stocks containing interfering substances, such as coated broke. The paper machine then has to be shut down and cleaned.

It is an object of the present invention to minimize or to eliminate said problems with deposition in the paper machine when processing paper stocks containing interfering substances, in particular when reusing coated broke.

We have found that this object is achieved, according to the invention, by a process for the production of paper, board and cardboard by draining a paper stock containing interfering substances have molar mass $M_w$ of at least 1 million, if a high-consistency stock is first prepared, at least one polymer containing vinylamine units and having an average molar mass $M_w$ of at least 1 million and a degree of hydrolysis of from 1 to 20 mol % is metered into the high-consistency stock, the high-consistency stock is diluted to a low-consistency stock by adding water, and the low-consistency stock is drained.

The consistency of the high-consistency stock is, for example, more than 2% by weight, based on dry paper stock. The degree of hydrolysis of the polymers is in most cases from 3 to 15 mol %. A high consistency stock having a consistency of from 3.0 to 6.0% by weight, based on dry paper stock, and polymers containing vinylamine units and having a degree of hydrolysis of from 5 to 12 mol % are preferably used as starting materials. The consistency of the high-consistency stock is preferably from 3.5 to 4.5% by weight, based on dry paper stock. After the addition of at least one polymer containing vinylamine units, the high-consistency stock is converted into a low-consistency stock by adding water, which low-consistency stock has a consistency below 1.5% by weight, based on dry paper stock. In general, the consistency of the low-consistency stock is below 1.2% by weight, for example from 0.5 to 1. % by weight, preferably from 0.6 to 0.9% by weight, based in each case on dry paper stock.

Paper stocks used in the novel process are those for whose preparation all fiber qualities or mixtures of fibers are suitable. Water is generally used in practice for the preparation of the paper stock and is at least partly, generally even completely, recycled from the paper machine. It is either clarified or unclarified white water or a mixture of such water qualities. The recycled water therefore contains larger or smaller amounts of interfering substances which are known to have a very adverse effect on the efficiency of the cationic retention and drainage aids or on the runability of the paper machine, cf. H. L. Baumgarten, Das Papier, Volume 38, Part 10 A, pages V121 to V125 (1984).

These interfering substances occur both in soluble and in insoluble and in colloidal form. Soluble interfering substances are, for example, humic acids, ligninsulfonate, silicic acids or wood extracts. Insoluble, lipophilic/hydrophobic interfering substances, i.e. stickies or white pitch, originate, for example, from process chemicals which are used in papermaking, from binders for the coating of paper and cardboard or from adhesives for paper processing. For example, they may be contact adhesives, dispersion adhesives or hotmelt adhesives or printing ink binders or may comprise materials from paper processing. Problems with the runability of the paper machine occur in particular with the use of wastepaper and during the recycling of coated broke. In the working-up of these paper stocks, relatively large particles, for example particles having a diameter of more than 50 μm, are separated off with the aid of mechanical methods. In a closed water circulation of a paper machine, however, larger particles may form from smaller particles which have a diameter of less than 50 μm and which cannot be separated off with the aid of mechanical methods, as a result of accumulation. In the papermaking process, this secondary sticky formation leads to troublesome deposits on the wire part, press section and drying section of the paper machine.

Suitable fibers for the preparation of the pulps are all qualities customary for this purpose, for example mechanical pulp, bleached and unbleached chemical pulp and paper stocks obtained from all annual plants. Mechanical pulp includes, for example, groundwood, thermomechanical pulp (TMP), chemothermomechanical pulp (CTMP), pressure groundwood, semi-chemical pulp, high-yield pulp and refiner mechanical pulp (RMP). Suitable pulps are, for example, sulfate, sulfite and soda pulps. Unbleached chemical pulp which is also referred to as unbleached kraft pulp is preferably used. Suitable annual plants for the preparation of paper stocks are, for example, rice, wheat, sugar cane and kenaf. Pulps are generally prepared using wastepaper, which is employed either alone or as a mixture with other fibers, or fiber mixtures comprising a primary stock and recycled coated broke, for example bleached pine sulfate as a mixture with recycled coated broke, are used as starting materials.

In order to avoid deposits on the paper machine and to improve the runability of the paper machine, polymers which contain vinylamine units and are obtainable by hydrolysis of homo- and/or copolymers of N-vinylcarboxamides are metered into the high-consistency stock. Hydrolyzed homopolymers of N-vinylformamide having a degree of hydrolysis of from 1 to 20 mol % are preferably used as polymers containing vinylamine units. The suitable polymers have an average molar mass $M_w$ of at least 1 million, in general from 1 to 10 million, preferably from 1.5 to 3.5 million, Dalton. The polymers have, for example, a charge density of from 0.5 to 5.0, preferably from 1.5 to 3.5, meq/g. Polymers containing vinylamine units are known from the prior art, cf. in particular EP-A-0 438 755, page 3, line 15 to page 4, line 20, U.S. Pat. No. 4,421,602 and EP-A-0 231 901. The polymers are obtainable by homopolymerization or copolymerization of N-vinylcarboxamides, such as N-vinylformamide, N-vinylacetamide, N-ethyl-N-vinylformamide, N-ethyl-N-vinylacetamide, N-methyl-N-vinylformamide, N-methyl-N-vinylacetamide and N-vinylpropionamide. N-Vinylformamide is preferably used as the starting material.

Suitable comonomers for the preparation of copolymers of N-vinylformamide are in particular vinyl formate, vinyl acetate, vinyl propionate, $C_1$- to $C_4$-alkyl vinyl ethers, N-vinylpyrrolidone, esters, nitrites and amides of monoethylenically unsaturated $C_3$- to $C_5$-carboxylic acids, in particular of acrylic acid or of methacrylic acid, and monoethylenically unsaturated $C_3$- to $C_5$-carboxylic acids. The esters of acrylic acid and methacrylic acid are derived, for example, from alcohols of 1 to 6 carbon atoms. The copolymers preferably contain from 95 to 10 mol % of N-vinylformamide and from 5 to 90 mol % of at least one other ethylenically unsaturated monomer. Hydrolyzed polymers which are obtainable by polymerization of (a) from 100 to 10 mol % of N-vinylformamide and
(b) from 0 to 90 mol % of vinyl formate, vinyl acetate, vinyl propionate, methyl acrylate, ethyl acrylate, methyl methacrylate and/or dimethyl maleate are preferably used, from 1 to 20 mol % of the polymerized vinylformamide units being eliminated from these polymers after the polymerization with formation of vinylamine units. Hydrolyzed homopolymers of N-vinylformamide having a degree of hydrolysis of from 1 to 20 mol % and an average molar mass $M_w$ of at least 1 million are very particularly preferably used in the novel process. The polymerization of the monomers is usually carried out in the presence of free radical polymerization initiators. The polymers can be polymerized by all known methods; for example, they are obtained by solution polymerization in water, alcohols, ethers or dimethylformamide or in mixtures of different solvents, by precipitation polymerization, inverse suspension polymerization (polymerization of an emulsion of a monomer-containing aqueous phase in an oil phase) and polymerization of a water-in-water emulsion, for example in which an aqueous monomer solution is dissolved or emulsified in an aqueous phase and polymerized with formation of an aqueous dispersion of a water-soluble polymer, as described, for example, in WO 00/27893.

After the polymerization, the polymers which contain polymerized units of N-vinylcarboxamides are partially hydrolyzed. The degree of hydrolysis of the vinylcarboxamide polymers is preferably from 3 to 15 and in particular from 5 to 12 mol %. The degree of hydrolysis corresponds to the content of vinylamine groups, in mol %, in the polymers. The hydrolysis is preferably carried out in the presence of an acid or of a base. However, the polymers can also be hydrolyzed enzymatically. In the hydrolysis with acids (for example mineral acids, such as sulfuric acid, hydrochloric acid or phosphoric acid, carboxylic acids, such as formic acid or acetic acid, or sulfonic acids or phosphonic acids), the corresponding ammonium salts of the polymers form, whereas, in the hydrolysis with bases, the vinylamine units of the polymers are present in the form of the free bases. In the hydrolysis of the copolymers of N-vinylformamide with vinyl esters, some or all of the vinyl ester units incorporated in the copolymer are converted into vinyl alcohol units. The vinylamine units of the polymers can, if appropriate, be modified by converting them in a known manner into the quaternization products, for example by reacting the polymers with dimethyl sulfate.

According to the invention, in the production of paper, the polymers containing vinylamine units are metered, for example, in an amount of from 0.002 to 0.1% by weight, based on dry paper stock, into the high-consistency stock.

The present invention also relates to the use of hydrolyzed homo- or copolymers of N-vinylcarboxamides having a degree of hydrolysis of from 1 to 20 mol % and an average molar mass $M_w$ of at least 1 million in the production of paper, board or cardboard as an additive to a high-consistency stock containing interfering substances, for reducing deposits in the wire part, press section and drying section of paper machines.

In the novel process, advantageously at least one retention aid is metered into the low-consistency stock. Retention aids which may be used are all polymeric substances described for this purpose. For example, the partially hydrolyzed homopolymers of N-vinylformamide, disclosed in U.S. Pat. No. 4,421,602, can be used as retention aids. The degree of hydrolysis of the polymerized N-vinylformamide units may be from 1 to 100%. However, it is also possible to use unhydrolyzed polymers of N-vinylformamide as retention aids. Such polymers have, for example, K values of at least 160, preferably from 180 to 300 (determined according to H. Fikentscher in 5% strength aqueous sodium chloride solution at 25° C. and a polymer concentration of 0.5% by weight).

Further suitable retention aids are, for example, polyacrylamides, which can be used in unmodified form or in cationically or anionically modified form. Copolymers of acrylamide or methacrylamide are cationically modified, for example by copolymerization with dialkylaminoethyl acrylates or dialkylaminoethyl methacrylates. Of particular interest as retention aids here are copolymers of acrylamide and N,N-dimethylaminoethyl acrylate or copolymers of acrylamide and N,N-diethylaminoethyl acrylate. The basic acrylates are contained in the copolymers, for example, in amounts of from 5 to 70, preferably from 8 to 40, mol % and are preferably present in a form neutralized with acids or in quaternized form. The quaternization can be effected, for example, with methyl chloride or dimethyl sulfate. Acrylamide and methacrylamide can also be anionically modified by copolymerization with monoethylenically unsaturated carboxylic acids. High molecular weight copolymers of, for example, acrylamide and acrylic acid are known retention aids. The content of anionic comonomers in the copolymers is, for example, from 5 to 50, preferably from 10 to 40, % by weight. The cationically or anionically modified poly(meth) acrylamides have, for example, K values of at least 180 (determined according to H. Fikentscher in 5% strength aqueous sodium chloride solution at 25° C. and a polymer concentration of 0.5% by weight).

Examples of cationic retention aids are polyethylenimines, polyamines having molar masses of more than 50 000, polyamidoamines which, if appropriate, are crosslinked by grafting with ethylenimine and subsequent crosslinking with, for example, polyethylene glycol dichlorohydrin ethers according to DE-C-24 34 816 or with epichlorohydrin, polyetheramines, polyvinylimidazoles, polyvinyltetrahydropyridines, polydialkylaminoalkyl vinyl ethers, polydialkylaminoalkyl (meth)acrylates in protonated or quaternized form, polydiallyldialkylammonium halides, in particular polydiallyldimethylammonium chloride. Particularly preferred retention aids are the polyamidoamines disclosed in the abovementioned DE-C-24 34 816 and grafted with ethylenimine and then crosslinked.

Other retention aids which may be used are the microparticle systems disclosed in the literature and comprising high molecular weight polyacrylamides and bentonite, a high molecular weight cationic polyacrylamide first being added to the paper stock, the paper stock being subjected to shearing and bentonite then being metered in. Processes of this type are, for example, the subject of EP-A-0 235 893 and of EP-A-0 335 575. A different sequence of metering of polymeric retention aid and inorganic particles, such as bentonite, is disclosed in DE-A-102 36 252. Cationic retention aids are preferably used. The retention aids are usually used in an amount of from 0.01 to 0.2% by weight, based on dry paper stock. The ratio of polymers containing from 1 to 20 mol % of vinylamine units and having molar masses of >1 million which are to be used according to the invention to retention aid is, for example, from 1:2 to 5:1.

In addition to at least one retention aid, further conventional products in the customary amounts may be added to the low-consistency stock in the production of paper, board and cardboard by the novel process, for example sizes, strength agents (wet and dry strength agents), biocides and/or dyes.

Unless stated otherwise, the percentages stated in the examples are percentages by weight. The molar masses were determined by static light scattering.

EXAMPLES

The following polymers were used:

PVAm 1: Polyvinylamine having a molar mass of 400 000 D (prepared by hydrolysis of poly-N-vinylformamide, degree of hydrolysis 95 mol %)

PVAm 2: Polymer of 30 mol % of vinylamine units and 70 mol % of N-vinylformamide units, having a molar mass of 400 000 D (prepared by partial hydrolysis of poly-N-vinylformamide)

PVAm 3: Polymer of 10 mol % of vinylamine units and 90 mol % of N-vinylformamide units, having a molar mass of 2 million D (prepared by partial hydrolysis of poly-N-vinylformamide)

Example 1

Wood-free coating paper having a basis weight of 150 g/cm$^2$ was produced continuously on a paper machine. The composition of the paper stock in the mixing chest consisted of 14% of bleached pine sulfate, 34% of bleached birch sulfite, 21% of coated broke and 31% of ground calcium carbonate, and the concentration of the paper stock was 4%, based on dry paper stock. The capacity of the paper machine was 20 t/h. The finished paper contained about 18% of ground calcium carbonate.

The fibers were fed to the mixing chest in separate trains. 400 g/t, based on coated broke, of PVAm 3 were metered, after the despecker, into the train in which the coated broke was transported. The paper stock present in the mixing chest and having a consistency of 4% was diluted to give a low-consistency stock having a concentration of 0.8%, based on dry paper stock, by adding water from the paper machine circulation. After passing through the vertical screen shortly before the head box, a retention system comprising 5 kg/t of a commercial cationic starch (degree of substitution DS=0.03) and 800 g/t of polyaluminum chloride in the form of an 18% strength aqueous solution was added to the low-consistency stock. The machine ran satisfactorily. After a run time of one month, the machine was routinely shut down and cleaned. The deposits on the machine were, however, not so serious that it would have been necessary to shut down the machine.

Comparative Example 1

Example 1 was repeated with the only exception that, instead of PVAm 3, 400 g/t of polyaluminum chloride in the form of an 18% strength aqueous solution were now metered into the train in which the coated broke was transported. The running properties of the machine and the quality of the paper produced are unsatisfactory. The paper production had to be stopped after a machine run time of 3 days in order to remove troublesome deposits on wire part, press section and drying section of the machine.

Comparative Example 2

Example 1 was repeated with the only exception that, instead of PVAm 3, 400 g/t of PVAm 1 were now metered into the train in which the coated broke was transported. Although the running properties of the machine and the quality of the paper produced are improved compared with comparative example 1, paper production likewise had to be stopped after a machine run time of 3 days in order to remove troublesome deposits on wire part, press section and drying section of the machine.

Comparative Example 3

Example 1 was repeated with the only exception that, instead of PVAm 3, 400 g/t of PVAm 2 were now metered into the train in which the coated broke was transported. Although the running properties of the machine and the quality of the paper produced are improved compared with comparative example 1, paper production had to be stopped after a machine run time of 4 days in order to remove troublesome deposits on wire part, press section and drying section of the machine.

We claim:

1. A process for producing paper, board or cardboard by draining a paper stock comprising interfering substances in the presence of one or more polymers which comprise vinylamine units and which have an average molar mass $M_w$ of at least 1 million, the process comprising preparing a high-consistency paper stock, metering at least one homopolymer of an N-vinyl carboxamide comprising vinylamine units and having an average molar mass $M_w$ of at least 1 million and a degree of hydrolysis of from 1 to 20 mol % into the high-consistency stock, diluting with water the high-consistency stock to a low-consistency stock, and draining the low-consistency stock.

2. The process according to claim 1, wherein the consistency of the high-consistency stock is more than 2% by weight, based on dry paper stock, and the degree of hydrolysis of the polymers is from 3 to 15 mol %.

3. The process according to claim 1, wherein the consistency of the high-consistency stock is from 3.0 to 6.0% by weight, based on dry paper stock, and the degree of hydrolysis of the polymers is from 5 to 12 mol %.

4. The process according to claim 1, wherein the consistency of the high-consistency stock is from 3.5 to 4.5% by weight, based on dry paper stock, and wherein the consistency of the low-consistency stock is brought to a concentration below 1.5% by weight, based on dry paper stock.

5. The process according to claim 1, wherein hydrolyzed homopolymers of N-vinylformamide having a degree of hydrolysis of from 1 to 20 mol % are used as polymers comprising vinylamine units.

6. The process according to claim 1, wherein at least one retention aid is metered into the low-consistency stock.

7. The process according to claim 1, wherein the amount of the polymers containing vinylamine units and metered into the high-consistency stock is from 0.002 to 0.1% by weight, based on dry paper stock.

8. The process according to claim 1, wherein the high-consistency stock comprising interfering substances comprises coated broke.

9. A method for reducing deposits in at least one of the wire part, press section and drying section of a paper machine in the production of paper, board or cardboard, comprising adding at least one hydrolyzed homopolymer of a N-vinylcarboxamide having a degree of hydrolysis of from 1 to 20 mol % and an average molar mass $M_w$ of at least 1 million as an additive to a high-consistency stock containing interfering substances.

10. The method according to claim 9, wherein the consistency of the high-consistency stock is more than 2% by weight, based on dry paper stock, and the degree of hydrolysis of the polymers is from 3 to 15 mol %.

11. The method according to claim 9, wherein the consistency of the high-consistency stock is from 3.0 to 6.0% by weight, based on dry paper stock, and the degree of hydrolysis of the polymers is from 5 to 12 mol %.

12. The method according to claim 9, wherein the consistency of the high-consistency stock is from 3.5 to 4.5% by weight, based on dry paper stock.

13. The method according to claim 9, wherein the at least one hydrolyzed homopolymer of a N-vinylcarboxamide comprises vinylamine units.

14. The method according to claim 13, wherein hydrolyzed homopolymers of N-vinylformamide having a degree of hydrolysis of from 1 to 20 mol % are used as polymers containing vinylamine units.

15. The method according to claim 13, wherein the amount of the polymers containing vinylamine units and metered into the high-consistency stock is from 0.002 to 0.1% by weight, based on dry paper stock.

16. The method according to claim 9, wherein the high-consistency stock comprising interfering substances comprises coated broke.

* * * * *